United States Patent [19]

Troughton

[11] Patent Number: 4,789,009

[45] Date of Patent: Dec. 6, 1988

[54] SIXTEEN HARNESS DUAL LAYER WEAVE

[75] Inventor: Brian H. P. Troughton, Herne Bay, Great Britain

[73] Assignee: Huyck Corporation, Wake Forest, N.C.

[21] Appl. No.: 937,549

[22] Filed: Dec. 3, 1986

Related U.S. Application Data

[63] Continuation-in-part of Ser. No. 817,017, Jan. 8, 1986, abandoned.

[51] Int. Cl.[4] ..... D03D 1/00

[52] U.S. Cl. ..... 139/383 A; 162/DIG. 1; 139/425 A

[58] Field of Search ..... 139/383 A, 425 A; 162/DIG. 1, 348; 428/255, 257

[56] References Cited

U.S. PATENT DOCUMENTS 4,499,927 2/1985 Borel .
4,564,052 1/1986 Borel ..... 139/425 A
4,569,375 2/1986 Borel .
4,640,741 3/1987 Tsuneo .
4,642,261 2/1987 Fearnhead .

FOREIGN PATENT DOCUMENTS 0048962 4/1982 European Pat. Off. .
0080686 6/1983 European Pat. Off. .
0085363 8/1983 European Pat. Off. .
2342368 2/1977 France .

*Primary Examiner*—Henry S. Jaudon
*Attorney, Agent, or Firm*—Lorusso & Loud

[57] ABSTRACT

An improved papermakers' fabric for use in papermaking, cellulose and similar machines, comprising a first layer of cross-machine direction yarns, which layer is intended in the position of use of the fabric to face the material to be formed, a second layer of cross-machine direction yarns stacked approximately under the first layer of cross machine direction yarns, which layer is intended in the position of use of the fabric to face the machine drive rollers, and machine direction yarns interweaving said two cross-machine direction layers. The paperside cross-machine direction yarns are woven for maximum cross-machine fiber support with alternate 6 float and 8 float sections. The machine side cross-machine direction yarns have a 14 float, ensuring high cross machine yarn volume available for wear before the load bearing machine direction yarns are subject to wear. The machine direction yarns are interwoven such that two adjacent machine direction yarns pass under the machine side cross-machine direction yarns directly under the paperside 6 float section, ensuring protection of the machine direction yarn and resulting in longer fabric life.

12 Claims, 4 Drawing Sheets

PAPER SURFACE

MACHINE SURFACE

MACHINE DIRECTION

| | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|
| 1 | X | X | 0 | 0 | 0 | 0 | 0 | 0 | 0 | 0 | 0 | 0 | 0 | 0 | 0 | 0 |
| 2 | X | X | X | X | 0 | X | X | X | X | X | X | X | X | 0 | X | X |
| 3 | 0 | 0 | 0 | 0 | 0 | 0 | X | X | 0 | 0 | 0 | 0 | 0 | 0 | 0 | 0 |
| 4 | X | X | X | 0 | X | X | X | X | X | X | 0 | X | X | X | X | X |
| 5 | 0 | 0 | 0 | 0 | 0 | 0 | 0 | 0 | 0 | 0 | 0 | 0 | X | X | 0 | 0 |
| 6 | 0 | X | X | X | X | X | X | X | X | 0 | X | X | X | X | X | X |
| 7 | 0 | 0 | X | X | 0 | 0 | 0 | 0 | 0 | 0 | 0 | 0 | 0 | 0 | 0 | 0 |
| 8 | X | X | X | X | X | X | 0 | X | X | X | X | X | X | X | X | 0 |
| 9 | 0 | 0 | 0 | 0 | 0 | 0 | 0 | 0 | X | X | 0 | 0 | 0 | 0 | 0 | 0 |
| 10 | X | X | X | X | X | 0 | X | X | X | X | X | X | 0 | X | X | X |
| 11 | 0 | 0 | 0 | 0 | 0 | 0 | 0 | 0 | 0 | 0 | 0 | 0 | 0 | 0 | X | X |
| 12 | X | X | 0 | X | X | X | X | X | X | X | X | 0 | X | X | X | X |
| 13 | 0 | 0 | 0 | 0 | X | X | 0 | 0 | 0 | 0 | 0 | 0 | 0 | 0 | 0 | 0 |
| 14 | X | 0 | X | X | X | X | X | X | 0 | X | X | X | X | X | X | X |
| 15 | 0 | 0 | 0 | 0 | 0 | 0 | 0 | 0 | 0 | 0 | X | X | 0 | 0 | 0 | 0 |
| 16 | X | X | X | X | X | X | X | 0 | X | X | X | X | X | X | 0 | X |

CROSS MACHINE DIRECTION

*FIG. 1*

MACHINE SURFACE

PAPER SURFACE

MACHINE SURFACE

SIXTEEN HARNESS DUAL LAYER WEAVE

REFERENCE TO RELATED APPLICATIONS

This application is a continuation-in-part application of prior application U.S. Ser. No. 817,017, entitled "Sixteen Harness Dual Layer Weave", filed Jan. 8, 1986, now abandoned. The teachings of the aforementioned application are incorporated herein by reference.

BACKGROUND OF THE INVENTION

This invention relates to woven papermakers' fabrics and especially to forming fabrics, including those known as fourdrinier belts or fourdrinier wires.

In the conventional fourdrinier papermaking process, a water slurry or suspension of cellulose fibers, known as the paper "stock" is fed onto the top of the upper run of a traveling endless belt. The belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through its mesh openings, also known as drainage holes, by vacuum means or the like located on the machine side of the fabric. In the conventional fourdrinier machine, the forming fabric also serves as a drive belt. Accordingly, the machine direction yarns are subjected to considerable tensile stress and, for this reason, are sometimes referred to as the load-bearing yarns.

Such papermakers' fabrics are manufactured in two basic ways to form an endless belt. First, they can be flat woven by a flat weaving process with their ends joined by any one of a number of well known methods to form the endless belt. Alternatively, they can be woven directly in the form of a continuous belt by means of an endless weaving process. Both methods are well known in the art and the term "endless belt" as used herein refers to belts made by either method. In a flat woven papermakers' fabric, the warp yarns extend in the machine direction and the filling yarns extend in the cross-machine direction. In a papermakers' fabric having been woven in an endless fashion, the warp yarns extend in the cross-machine direction and the filling yarns extend in the machine direction. As used herein the terms "machine direction" and "cross-machine direction" refer respectively to a direction equivalent to the direction of travel of the papermakers' fabric on the papermaking machine and a direction transverse this direction of travel.

Effective sheet support and lack of wire marking are important considerations in papermaking, especially in the formation of the wet web. The problem of wire marking is particularly acute in the formation of fine paper grades where the smoothness of the sheet side surface of the forming fabric is critical as it affects paper properties such as sheet mark, porosity, see-through, pinholing and the like. Accordingly, paper grades intended for use in carbonizing, cigarettes, electrical condensers, quality printing and like grades of fine paper have heretofore been formed on very fine woven forming fabrics or fine wire mesh forming fabrics. Such forming fabrics, however, are delicate, lack stability in the machine and cross-machine directions, and are characterized by relatively short service lives. U.S. Pat. No. 4,564,052 to Borel describes a dual layer fabric having a double float in the machine direction yarns and planar support for the paper stock provided by directly adjacent machine direction wires, rather than the cross-machine direction wires, which are guided parallely through the weft wires to reduce wire marking. The construction of this fabric, however, does not enhance abrasion resistance or wear of the fabric.

It is known to use coarser and stronger fabrics for good service life, which also have reduced amplitude of sheet side knuckles, as in the fabric described in U.S. Pat. No. 4,239,065 to Trokhan.

Similarly, fabrics are known which employ a number of different approaches to improvement of sheet support. Fabrics are frequently inverted to take advantage of the fiber support orientation of the cross-machine direction yarns. Sheet forming on the cross-machine direction yarns does not directly block the smallest of the drainage holes, those which exist between machine direction yarns, and therefore, the fabric drains better and performance improves. Unfortunately, the cross-machine direction yarns are the most widely spaced yarns, and wire marking increases. In an attempt to improve sheet support yet avoid excessive wire marking, fabrics have been produced with increased picks or ends in the conventional weave patterns. This fabric, however, has a reduced rate of drainage and fabric performance.

In short, in order to ensure good paper quality, the side of the papermakers' fabric which contacts the paper stock should provide high support for stock, preferably in the cross-machine direction because support is already provided in the machine direction. Conversely, the side of the papermakers' fabric which contacts the rollers and machine must be tough and durable; these qualities, however, most often are not compatible with the good drainage and fabric characteristics desired for a papermakers' fabric.

In order to meet both standards, fabrics like the one in U.S. Pat. No. 3,885,603 to Philip H. Slaughter are employed. The papermakers' fabric is produced from two different fabrics, one having the qualities desired in the paper-contacting side and the other with the qualities desired in the roller-contacting side, stitched together. This type of papermakers' fabric is commonly called a "triple layer fabric". Alternatively, two layers of fabric can be woven at once by utilizing threads of different sizes or of different materials and another thread to bind them together, as in the fabric described in U.S. Pat. No. 4,041,989 to Johansson et al. This fabric is commonly called a "duplex fabric". The problem with both these papermakers' fabrics, however, has been that the thread which interconnects the two layers forms undesirable knuckles, which degrade the paper quality and snag as the fabric slackens with use.

SUMMARY OF THE INVENTION

In accordance with the present invention, there is provided an improved papermakers' fabric, for use in papermaking, cellulose and similar machines, comprising a first layer of cross-machine direction yarns which face the material to be formed in use, a second layer of cross-machine direction yarns which face the machine drive rollers in use and machine direction yarns woven as sixteen harnesses interweaving the two cross-machine direction layers. Because of the configuration of the weave, pairs of the cross-machine direction yarns are usually stacked and the fabric has 90–120% cover in the machine direction. As a result, the fabric has excellent drainage capability and stretch resistance.

The machine side cross-machine direction yarns have a 14 float ensuring excellent cross machine yarn volume available for wear before the load-bearing machine direction yarns are subject to wear. The paperside cross-machine direction yarns are arranged with alternate 6 float and 8 float sections so there is excellent cross machine direction fiber support because approximately 90% of the yarns are located on the surface. Two adjacent machine direction yarns pass under the machine side cross-machine direction yarns directly under the paperside 6 float section, and this ensures good burial of the machine direction yarn, resulting in longer wire life and also ensures an excellent papermaking surface.

Accordingly, it is an object of the present invention to provide a papermakers' fabric, particularly a forming fabric, having both improved sheet support and sheet support surface smoothness. However, the present invention would also provide advantages in the conveying, press and dryer sections.

It is a further object of the present invention to provide a papermakers' fabric having enhanced drainage capability.

It is another object of the present invention to provide such a papermakers' fabric having excellent machine and cross-machine direction stability and long service life.

These and other objects of the present invention will become apparant to those skilled in the art from a reading of the ensuing description in conjunction with the drawing, in which like reference numbers refer to like members throughout the various figures.

BRIEF DESCRIPTION OF THE DRAWINGS

FIG. 1 is a weave diagram of the fabric of the present invention;

DETAILED DESCRIPTION OF THE INVENTION

Figure 6:
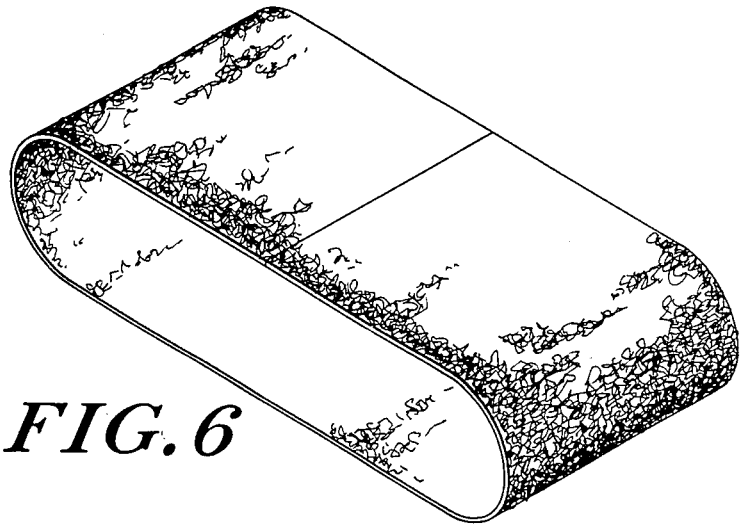
FIG. 6 is a plan view of the fabric of the present invention made into an endless belt configuration.

The fabric may be woven endless (machine direction=weft) or flat (machine direction=warp). A flat weave is preferred from the viewpoint of maintaining loom productivity. On the other hand, an endless weave eliminates the tedious process of seam formation but also reduces loom productivity by increasing the number of cross-machine direction yarns required for a given fabric size. In use, the fabric will be woven into and used as an endless belt configuration, as shown in FIG. 6.

Material chosen for the fabric must have both dimensional stability and abrasion resistance. At the points where the fabric supports the paper (the first layer of cross-machine direction yarns), the yarns must be dimensionally stable. Where the fabric comes in contact with the machine rollers (the second layer of cross-machine direction yarns), they must be abrasion resistant. The yarns should be monofilaments and are preferably synthetic yarns of materials conventionally used in such fabrics such as polyamides, polyesters and acrylic fibers or copolymers. Preferred for purposes of the present invention are monofilament yarns of polyethylene terephthalate (PET). In many high wear applications, however, PET yarns are subject to wear which will result in such problems as belt instability and reduced papermaking machine efficiency. On the bottom layer, then, every other yarn is preferably polyamide, which does not wear as easily as PET. For purposes of the present invention, and especially for forming fabrics for the wet end of the paper machine, machine direction yarns will typically have a yarn diameter in the range of 0.15 mm to 0.35 mm, while the cross-machine direction yarns will range from 0.17 mm to 0.55 mm.

Reference is first made to FIG. 1. This figure is a weave diagram illustrating the weave pattern of the fabric of the present invention on sixteen harnesses. The sixteen horizontal rows of the diagram, numbered 1 through 16, represent sixteen cross-machine direction yarns. Cross-machine direction yarns 1, 3, 5, 7, 9, 11, 13 and 15 are the machine side cross-machine direction yarns. Cross-machine direction yarns 2, 4, 6, 8, 10, 12, 14 and 16 are the paperside cross-machine direction yarns. The vertical columns of the diagram, numbered 17 through 32, represent the sixteen machine direction yarns. The "X" marks on the diagram represent those points at which the machine direction yarns are woven above the cross-machine direction yarn indicated at that point. The "0" marks in the diagram illustrates those points at which the machine direction yarns are woven under the cross-machine direction yarn indicated at that point. When the fabric is woven on sixteen harnesses, the resulting fabric is a dual-layer fabric.

The pattern repeats on every 16 cross-machine direction yarns, and on every 16 machine direction yarns. In the various figures, one weave repeat is designated as 1 through 16 for the cross-machine direction yarns and 17 through 32 for the machine direction yarns. Other repeats, or part repeats of this pattern, are shown with the yarn numbers in brackets.

Figure 2:
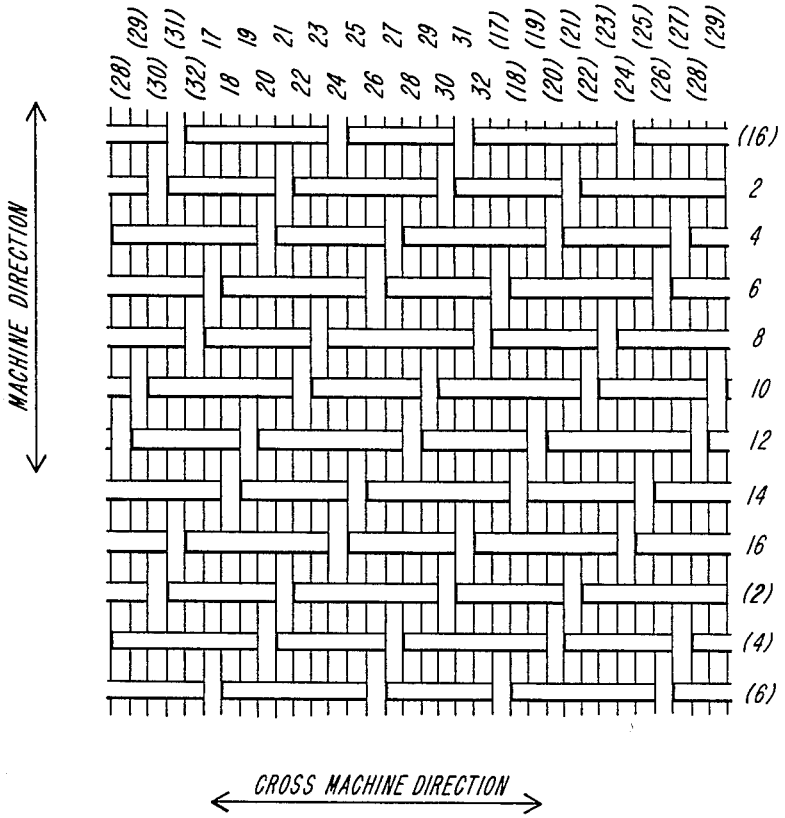
FIG. 2 is a plan view of the papermaking surface of the fabric of the present invention.

FIG. 2 is a schematic diagram illustrating the paper making surface of the fabric. This shows the characteristic good cross machine support which enhances papermaking. The stock contacts the cross machine direction yarns at 14 points, in alternate 6 float and 8 float sections, in the sixteen harness weave, or for approximately 85–90% of the weave repeat. There is therefore a high exposure of cross machine direction yarns which will be sufficient to support the pulp of fibres deposited thereon. Sheet release is also improved.

Figure 3:
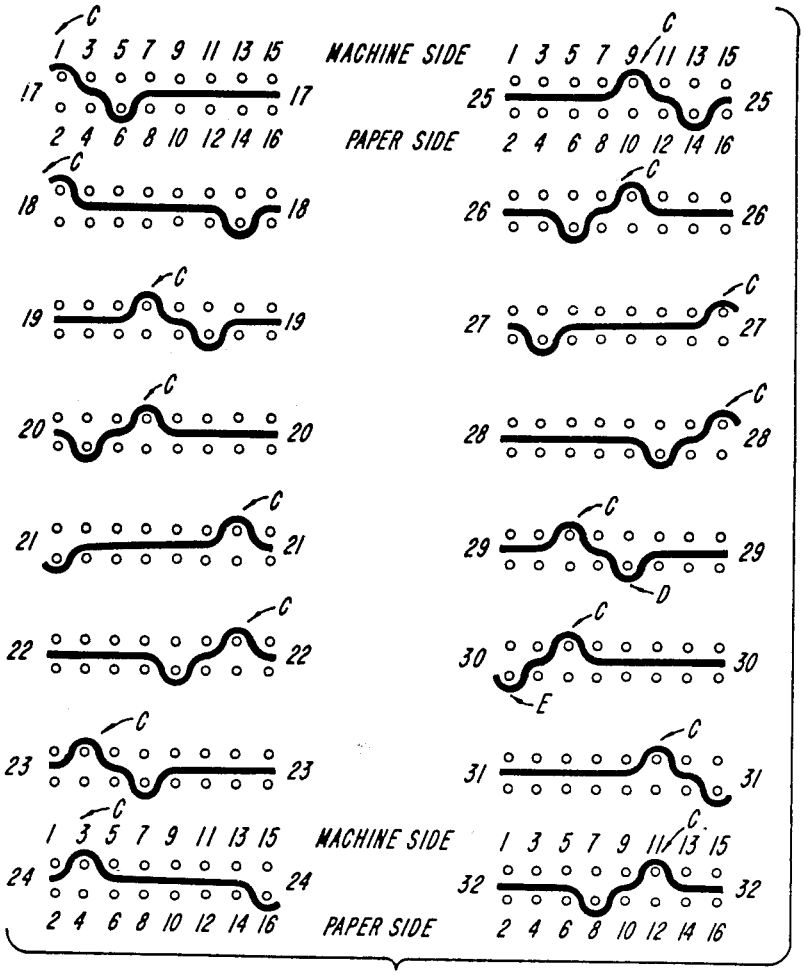
FIG. 3 is a schematic representation of the path of 16 machine direction yarns in relation to the cross-machine direction yarns.

As shown in FIG. 3, the fabric is woven and heat set so that the pairs of cross-machine direction yarns are stacked, one on top of the other, to enhance drainage. This stacking does not have to conform to one cross machine direction yarn being directly on top of the other, as they are in FIG. 3, which is the optimum condition for good drainage, but can be a situation where one yarn is approximately over the other.

Because of the two levels of cross machine direction yarns, it is possible to have a fabric with 90–120% machine direction cover, which allows excellent stretch and load-bearing characteristics without inhibiting drainage.

FIG. 3 is a schematic cross-sectional representation in the machine direction of the fabric of the present invention, illustrating the 16 adjacent machine direction yarns in one weave repeat and showing their relative position with respect to the same cross-machine direction yarns. That part of the fabric which, in position of use, faces the machine rollers, and that part which contacts the paper stock are designated.

Due to the configuration of the weave, the machine direction yarns go under the machine side cross machine direction yarns at the points labelled "C". In that two adjacent machine direction yarns, for example machine direction yarns 29 and 30, pass over the same cross machine direction yarn 5 at one point, then during the stretching and heat-setting operation, the degree to which these machine direction yarns are buried into the fatric at the cross over point is increased. This enhanced burial means there will be more life potential in the fabric before the load-bearing machine direction yarns start to be worn.

In FIG. 3, the juxtaposition of the point "D" in relation to the point "C" on machine direction yarn 29, together with the juxtaposition of the point "E" in relation to the point "C" on the machine direction yarn 30, will further increase the forces, during the stretching and heat-setting process, that lead to the burial of the machine direction yarns on the machine side of the fabric. This will result in a further gain to fabric life potential.

Figure 4:
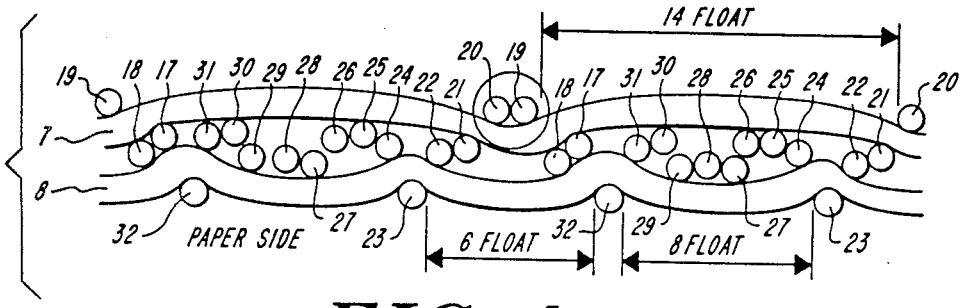
FIG. 4 is a cross-sectional view of the fabric of the present invention, showing two cross-machine direction yarns and their relationship to the machine direction yarns.

The fabric is again shown in cross-section in FIG. 4. This section shows a fragmentary longitudinal section through a pair of cross machine direction yarns, 7 and 8, and transverse section through machine directional yarns, 17 through 32. Again the sides of the fabric which face the machine rollers and paper stock are indicated. It is evident in FIG. 4 that two adjacent machine direction yarns 19 and 20 pass together over the machine side cross machine direction yarn 7. This ensures good burial of the machine direction yarn, resulting in longer wire life and more balanced forces within the fabric.

As can also be seen in FIG. 4, the machine side cross machine direction yarns have a fourteen float available for wear. Because the float is longer than that achieved with a conventional dual layer weave, there is more crimp in the machine side cross machine direction yarns. This means that there will be more volume of these yarns available for wear, before the machine direction yarns are exposed to wear.

The paperside cross machine direction yarns have alternate 6 floats and 8 floats as illustrated in FIG. 4. Without extraneous forces, these different float lengths would crimp to different degrees resulting in a rough and perhaps unacceptable surface for paper making. Specifically, the 8 float section of yarn would project further upwards than the 6 float section of yarn. However, in this invention, the two adjacent machine direction yarns 19 and 20 (circled in FIG. 4) as they pass over the machine side cross machine direction yarn, are placed directly over the paperside 6-float. These yarns together have the effect of pushing the machine side cross machine direction yarr up into the fabric. As a result of this the 6 float is lengthened and heightened so it may be coplanar with the 8 float.

Figure 5:
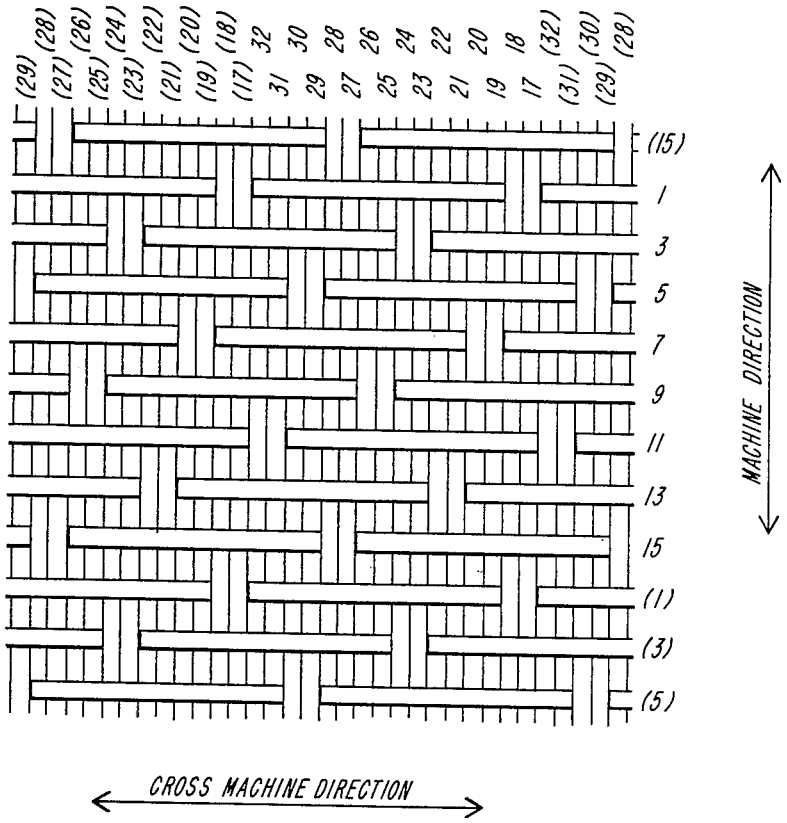
FIG. 5 is a plan view of the machine side of the fabric of the present invention.

FIG. 5 is a schematic diagram of the machine side of the fabric, and shows the positioning of the 14 floats, which are available for wear. FIG. 5 also illustrates the two adjacent machine direction yarns which pass under the same machine side cross-machine direction yarn at the same point.

EXAMPLE

A papermakers' fabric was woven flat having a 16-harness weave. Machine direction yarns are of polyethylene terephthalate (PET) monofilaments having a diameter of 0.15 mm. Cross-machine direction yarns are disposed one above the other and are likewise monofilaments. The cross-machine direction yarns of the paperside are PET monofilaments having a diameter of 0.17 mm. The machine side cross-machine yarns alternate PET and polyamide monofilaments, both of diameter 0.17 mm.

The fabric is woven in 16 harnesses as illustrated in the weave diagram of FIG. 1. FIG. 2 shows the papermaking surface of the finished woven fabric and FIG. 5 shows the machine side surface of the finished woven fabric. In the final state, the fabric includes 70 machine direction wires per centimeter providing 105% cover in the machine direction. The fabric has 2×30 cross-machine direction wires per centimeter and the weft density of the finished product is 51% cover on each surface. The machine side cross-machine direction yarns have a 14 float and the paperside cross-machine direction yarns are arrarged with an alternate 6 float and 8 float section, with two adjacent machine direction yarns passing under the machine side cross-machine direction yarns directly under the paperside 6 float section.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A dual-layer papermakers' fabric comprising an endless belt formed of machine direction and cross-machine direction yarn systems interwoven on sixteen harnesses, having a paper stock-contacting layer of cross-machine direction yarns;

a machine-contacting layer of cross-machine direction yarns positioned with respect to the paper stock-contacting layer of cross-machine direction yarns so as to be on top of one another;

machine direction yarns, said machine directions yarns being interwoven with the cross-machine direction yarns in such a way to interconnect the cross-machine direction yarns so that said machine-contacting layer of cross-machine direction yarns has a fourteen float, said paper stock-contacting layer of cross-machine direction yarn has alternate six float and eight float sections and two adjacent machine direction yarns pass over the machine-contacting cross-machine direction yarns directly over the six float section of the paper stock-contacting cross-machine direction yarns.

2. The papermakers' fabric of claim 1 wherein said fabric is a forming fabric.

3. The papermakers' fabric of claim 1 wherein said paper stock-contacting layer of cross-machine direction yarns are comprised of polyethylene terephthalate.

4. The papermakers' fabric of claim 3 wherein alternate cross-machine direction yarns of the machine-contacting layer comprise polyamide.

5. The papermaker' fabric of claim 1 wherein said yarns comprise polyethylene terephthalate, polyamides, polyesters, acrylics or copolymers.

6. A method to manufacture papermakers' fabric comprising:

providing a paper stock-contacting layer of cross-machine direction yarns;

providing a machine-contacting layer of cross-machine direction yarns positioned with relation to the paper stock-contacting layer so as to form a pair of yarns essentially one on top of the other;

interweaving the machine direction yarns with the cross-machine direction yarns to interconnect them providing a fourteen float on said machine-contacting layer of cross-machine direction yarns and six float and eight float sections on said paper stock-contacting layer of cross-machine direction yarns, with two adjacent machine direction yarns passing over said machine-contacting layer of cross-machine direction yarns directly over the six float section of said paper stock-contacting cross-machine direction yarns.

7. The method of claim 6 wherein the paper stock-contacting layer of cross-machine direction yarns comprise polyethylene terephthalate, and the machine-contacting layer of cross-machine direction yarns comprise alternate yarns of polyethylene terephthalate and polyamide.

8. A dual-layer papermakers' fabric for use on a papermaking machine for the production of paper from paper stock, said dual-layer papermakers' fabric comprising an endless belt formed of machine direction and cross-machine direction yarn systems interwoven on sixteen harnesses, having a paper stock-contacting layer of cross-machine direction yarns;

a machine-contacting layer of cross-machine direction yarns positioned with respect to the paper stock-contacting layer of cross-machine direction yarns so as to be directly on top of one another; and machine direction yarns interwoven with said cross-machine direction yarns in such a way to interconnect said cross-machine direction yarns so that the machine contacting-layer of cross-machine direction yarns has a fourteen float and the paper stock-contacting layer of cross-machine direction yarns contacts the paper stock at fourteen points in the sixteen harness weave, and two adjacent machine direction yarns pass over only one machine-contacting cross-machine direction yarn.

9. The papermakers' fabric of claim 8 wherein said fabric is a forming fabric.

10. The papermakers' fabric of claim 8 wherein said cross-machine direction of paper stock-contacting layer yarns are comprised of polyethylene terephthalate.

11. The papermakers' fabric of claim 10 wherein alternate cross-machine direction yarns of the machine-contacting layer comprise nylon.

12. A method to manufacture papermakers' fabric for use on a papermaking machine for the production of paper from paper stock, said method comprising:

providing a paper stock-contacting layer of cross-machine direction yarns;

providing a machine-contacting layer of cross-machine direction yarns positioned with relation to the paper stock-contacting layer so as to form a pair of yarns, essentially one on top of the other;

interweaving machine direction yarns with the cross-machine direction yarns to interconnect said cross-machine direction yarns so that two adjacent machine direction yarns pass over only one machine-contacting cross-machine direction yarn, the machine-contacting layer of cross-machine direction yarns has a fourteen float and the paper stock-contacting layer of cross-machine direction yarns contacts the paper stock at fourteen points in the sixteen harness weave.

* * * * *